US005409067A

United States Patent [19]

Esposito et al.

[11] Patent Number: 5,409,067

[45] Date of Patent: Apr. 25, 1995

[54] PORTABLE FIRE FIGHTING TOOL

[75] Inventors: John Esposito, Barnegat; Norman E. Atwater, Jackson, both of N.J.

[73] Assignee: Augustus Fire Tool TM, Inc., Island Heights, N.J.

[21] Appl. No.: 203,039

[22] Filed: Feb. 28, 1994

Related U.S. Application Data

[63] Continuation-in-part of Ser. No. 155,213, Nov. 22, 1993, abandoned.

[51] Int. Cl.[6] ..... A62C 3/07

[52] U.S. Cl. ..... 169/62; 169/70; 169/74

[58] Field of Search ..... 169/70, 71, 74, 62; 239/552

[56] References Cited

U.S. PATENT DOCUMENTS

| | | | |
|---|---|---|---|
| 1,377,431 | 5/1921 | Pfeil | 169/70 |
| 1,756,582 | 4/1930 | Butler | 169/70 X |
| 1,758,119 | 5/1930 | Le Moon | 239/552 X |
| 2,413,083 | 12/1946 | Snowden et al. | 169/70 X |
| 2,756,829 | 7/1956 | Phillips . | |
| 2,813,753 | 11/1957 | Roberts | 169/70 X |
| 2,967,570 | 1/1961 | Nurkiewicz | 169/70 |
| 3,045,761 | 7/1962 | Cairlo | 169/70 |
| 3,140,720 | 9/1963 | Sullivan | 169/70 |
| 4,219,084 | 8/1980 | Gray et al. | 169/70 X |
| 4,625,808 | 12/1986 | Halfpenny | 169/70 X |
| 4,676,319 | 6/1987 | Cuthbertson | 169/70 |
| 4,697,740 | 10/1987 | Ivy | 169/70 X |
| 4,802,535 | 2/1989 | Bakke | 169/70 |
| 5,062,486 | 11/1991 | McClenahan | 169/62 |
| 5,253,716 | 10/1993 | Mitchell | 169/70 |

OTHER PUBLICATIONS

Car Engine Fires: Tactics for Quick Knockdowns, by Brian G. Anderson, *Fire Engineering*, vol. 147, No. 2, Feb. 1994, pp. 37–44.

*Primary Examiner*—David M. Mitchell
*Assistant Examiner*—Gary C. Hoge
*Attorney, Agent, or Firm*—Stephen W. White

[57] ABSTRACT

A portable fire fighting tool that is connectable to a portable fire extinguisher is described. This tool comprises a penetrating head with a removable, sharp cutting element thereon and wherein the penetrating head is preferably connected at 90° to a linear, hollow handle. At the opposite end of the handle a quick connect device may be used to connect a portable fire extinguisher and the handle together. This tool is especially useful in fighting an automobile or truck engine or trunk compartment fire when the automobile or truck is locked preventing entry into the engine compartment or the trunk. By forcing the penetrating head down and through the sheet metal of the engine or trunk compartment, the cutting element cuts through the sheet metal. When the fire extinguisher is discharged, the fire extinguishing agent (e.g. foam, water, dry chemical, Halon ® or $CO_2$) flows down over the cutting element in an umbrella-like fashion extinguishing the fire without doing further damage to the automobile or truck.

11 Claims, 4 Drawing Sheets

PORTABLE FIRE FIGHTING TOOL

CROSS-REFERENCE TO RELATED APPLICATIONS

This invention is a Continuation-In-Part of our previously filed application on the same subject, U.S. Ser. No. 08/155,213, filed Nov. 22, 1993.

BACKGROUND OF THE INVENTION

1. Field of the Invention

This invention relates to the field of fire fighting and specifically to a portable tool usable by one person to fight fires. More specifically, this invention relates to a portable fire fighting tool that can be used in combination with a plurality of fire extinguishing agents to fight fires. Still more specifically, this invention relates to a combination of a portable tool coupled with any one of a plurality of fire extinguishing agents that can be used to fight a fire that is present in the engine and or the trunk compartment of a vehicle such as an automobile or truck, for example. These fires are dangerous in nature and during the extinguishing process, while trying to gain access to the vehicle and or the engine compartment, significant damage usually occurs to the body of said vehicle. Even more specifically, this invention relates to such a device that can be easily and quickly used by a single person to deliver an extinguishing agent directly to source of a fire which may be present in the engine or trunk compartment of an automobile that is locked and or left unattended.

2. Description of the Prior Art

There are a host of fire fighting tools available in the prior art. One in particular describes a spear-headed tool rigidly attached to a tank containing a fire extinguishing agent (probably a liquid). The spear is used to puncture through a pneumatic tire of an automobile or truck which contains fire. This type of fire is particularly noted in operating trucks where the tire may build up sufficient heat to cause burning inside the tire or tube contained therein. The so-called "tire fire" is considered dangerous and this device can be used to flood the inner portion of the tire with a fire extinguishing agent thus reducing the danger. The device not only has a spear head but also contains some sort of foot pressing element to help penetrate the tire.

There are still other prior art fire fighting tools that are used in combination with a high volume liquid (e.g. foam or water) as the source of fire extinguishing agent in order to fight one or more specific fires. Other prior art elements describe tools that can be attached to a hose which is further attached to a high volume, high pressure source of fire extinguishing agent such as water and the like. These devices have some sort of sharp end which can be used to penetrate a wall, structure or other obstacle behind which a fire may be occurring. Fire extinguishing material is then forced through this obstacle to fight the fire. Most of these devices are not designed to be used by a single fire fighter but must be controlled by two or more. Some of these elements even require the use of another tool such as a sledge hammer to get the device to penetrate the structure. These prior art elements are also cumbersome and made from a complicated system of parts that usually require some sort of assembly in the field prior to use.

There are other devices described for fighting fires in aircraft and the like. Most of these elements are large and clumsy devices that contain a host of cumbersome and complicated parts that are combined with a high volume of fire extinguishing agent (e.g. usually a liquid) and can penetrate the side or body of the aircraft in order to fight the fire that may be contained therein. Most of these devices must be used by more than one fire fighter because of the size thereof.

The prior art also teaches that in order to fight a fire contained within the engine compartment of a vehicle, it is necessary to pry open the hood of the engine compartment or to smash through the top of the hood in order to get a volume of extinguishing material to that fire. Alternatively, the prior art teaches that certain devices may be used to smash through the fender or to puncture out a head lamp in order to gain access to the fire. All of these prior art methods tend to wreak havoc on the body of the automobile. If the fire does not destroy the vehicle, the methods for gaining access to the fire surely will do the same.

In the field of fighting fires that are associated with a vehicle such as an automobile or truck and specifically with fires in the engine compartments of said vehicle, there is a pressing need to offer a portable device that can be used immediately to fight these fires expeditiously and without causing severe damage to the vehicle itself. For example, some of these fires (the so-called "engine fires") occur while the vehicle is locked and unattended and thus the fire fighter, or other responsible person, must pry open the hood in order to get right to the engine fire. This prying utilizes precious fire fighting time and can cause a great deal of body damage to the vehicle. However, if this is not done, the fire will consume the entire vehicle and this is not satisfactory. Additionally, this is not a safe way in which to fight an engine fire since if the hood is opened quickly, fire may rage out of control and affect those trying to extinguish this fire. Under certain circumstances, e.g. when a vehicle is parked in a garage or on a ferry boat, there is always the possibility of having a fire within the engine compartment, since the engine may still be hot. When this happens, it is difficult to get standard fire fighting equipment on the site because the normally available equipment is bulky and difficult to move among a plethora of parked vehicles. One can imagine the panic and confusion that could result on a crowded ferry boat with the capacity to carry passenger cars, trucks and tractor trailers and other vehicles which are placed in a line, when the operators of the ferry have to stretch out fire hoses and the like to fight an engine fire in a parked vehicle in and amongst many other vehicles. By the time they reach the vehicle on fire, the fire may be consuming not only that vehicle but the surrounding vehicles and the ferry boat itself. Thus, there is a pressing need to provide an easy, quick and efficient system that can be used by a single individual to permit the fighting of engine fires without causing serious side damage to the body of the vehicle and one that can be used swiftly and safely by the fire fighter.

SUMMARY OF THE INVENTION

It is an object of this invention to provide a simple, portable device that can be used with a plurality of fire extinguishing agents and the like to fight engine fires. It is another object of this invention to provide such a device that can be used to penetrate the hood or trunk compartment of a vehicle (e.g. automobile or truck) in which a fire (e.g. engine fire) is occurring without causing significant damage thereto and one that can be used quickly, safely and efficiently by a single fire fighter or "first responder". These and yet other objects are achieved in a portable fire fighting tool comprising a hollow linear handle element having a quick connecting means on one end thereof and a penetrating head element on the other end, wherein said penetrating head element comprises a body with a hollow interior tapering down to a flared end having a sharp, removable cutting element on one end, said cutting element comprising a shaft insertable and connectable within said tapered and flared end and a cutting tip having a top and a sharp point extending out from said shaft, wherein when a line is extended through said hollow interior of said penetrating element, said line forms an angle of 45° to 120° to said handle element, said cutting element, said shaft having a series of flutes therein and said hollow tapered and flared end of said body having a series of grooves therein, said flutes in said shaft of said cutting element forming a series of holes emanating from the top of said cutting tip when said cutting element is mated to said flared and tapered end of said hollow body of said head by inserting said shaft therein, said holes providing openings to the hollow interior of said body of said penetrating element, the hollow portion of said penetrating element being connected to said hollow handle element permitting a flow through said handle to the interior of said penetrating element.

DETAILED DESCRIPTION OF THE DRAWINGS

Figure 1:
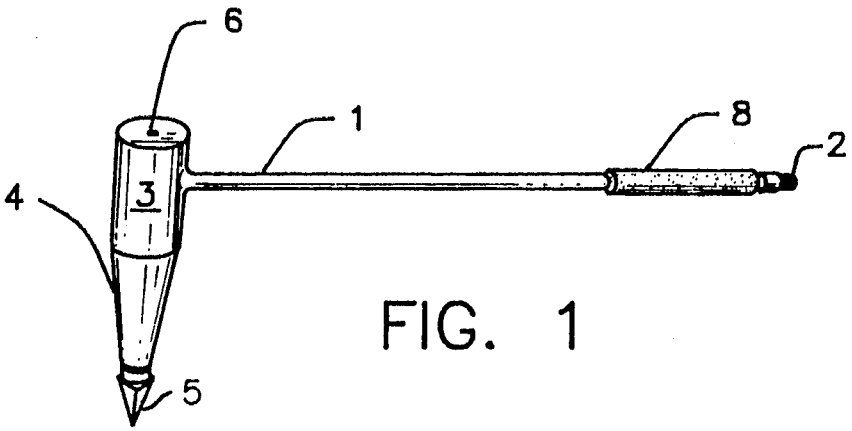
FIG. 1 is an overall side view of the portable, fire fighting device of this invention in the preferred mode. In this figure, the penetrating head and linear handle are connected by welding and a quick connection device is shown on one end of the handle.

Referring now specifically to the attached drawings which show the best mode of this invention at the time of filing, FIG. 1 is a showing of the element of this invention in its preferred mode. In this figure, 1 is the hollow linear handle having a quick connecting means 2 on one end thereof and a penetrating head element 3 on the other end. The head element comprises a body 4 and a sharp, removable cutting element 5 on one end thereof. The body is hollow (a feature not shown in this figure) and when connected to the hollow, linear handle 1 will permit fire extinguishing agent to pass through and down over the cutting element 5. An attaching means for the cutting element 5 is shown at 6. In this particular mode, the attaching means is a long, threaded bolt which travels down through the hollow head and into the shaft 7 of the cutting element (also not shown in this particular figure). This particular bolt may be of the flush or recessed type. A grip 8 is shown at one end of the linear handle 1. This grip is a preferred part of the device of this invention, although not a requisite part. In this view, the head and handle form a 90° angle to each other.

Figure 2:
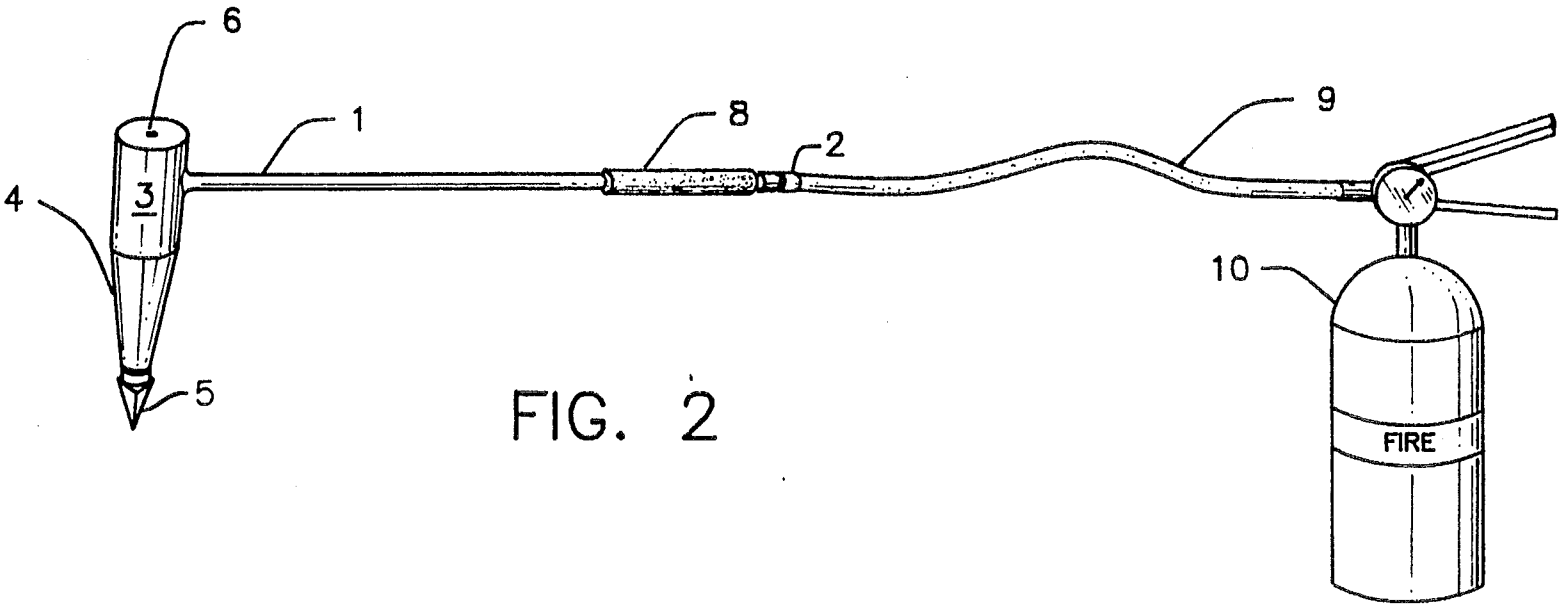
FIG. 2 demonstrates the attachment of a portable fire extinguisher by a host connected to the quick connection device of FIG. 1.

FIG. 2 is a showing of the device of FIG. 1 attached by a hose means 9 to a typical fire extinguisher 10, which may contain any of the conventional fire extinguishing agents. The hose 9 will have a matched quick connecting device on the end opposite to that attached to the fire extinguisher so as to permit quick connection to the device of this invention.

Figure 3:
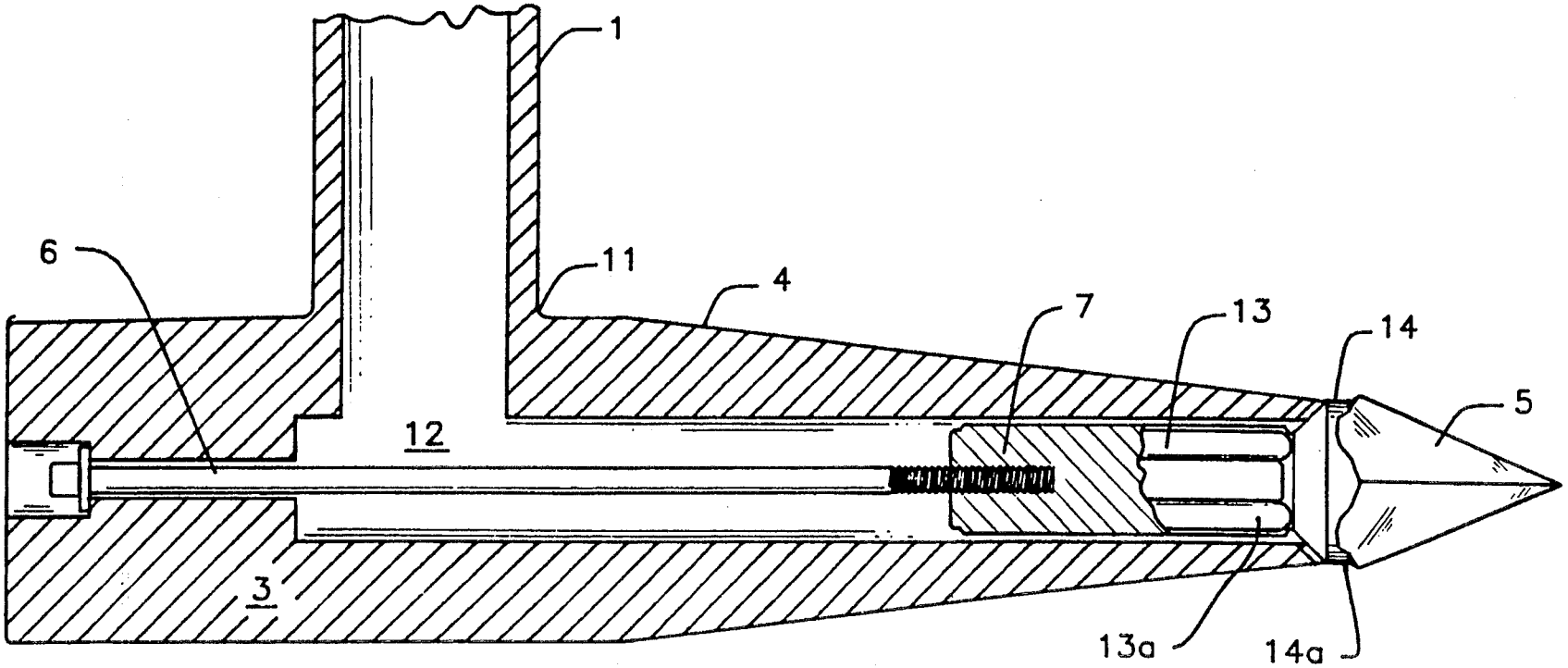
FIG. 3 is a detailed showing of the penetrating head element of the device of this invention.

FIG. 3 is a more detailed showing of the head element 3. In this figure, the hollow linear handle 1 is shown attached by welding at 11 to the body 4 of the head 3. The attaching means 6 for the cutting element 5 is shown as a recessed bolt down through the body 4 of the head 3 and threaded into shaft 7 of the removable cutting element 5. The hollow portion of the head 3 and the handle 1 is shown as 12. Also seen in this showing are two flutes 13 and **13*a* placed in the shaft 7 of the cutting element 5. Additional flutes (not seen) may be added and are preferred. A series of grooves are also present within the hollow flared end of the body 4 that make contact with the cutting element 5, but these are not shown in this figure. Holes, shown by 14 and 14*a* will be formed when the cutting element 5 is mounted properly in the body 4**. It is through these holes that the fire extinguishing agent will pass in an umbrella-like fashion to fight the vehicle fire.

Figure 4:
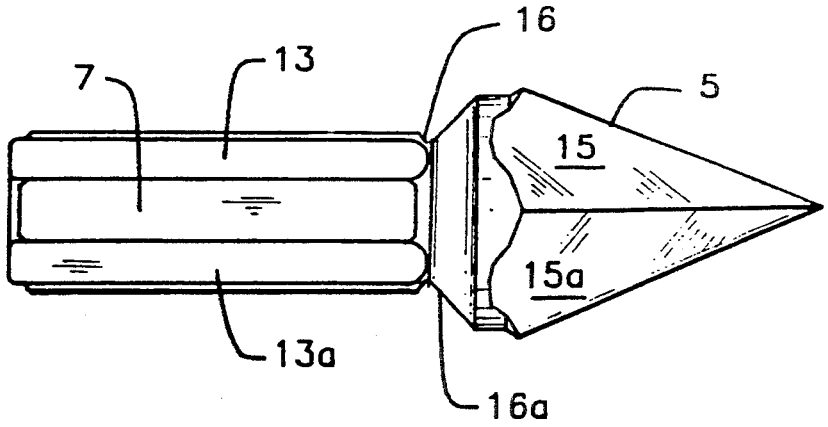
FIG. 4 is a detailed showing of the sharp, cutting element of the penetrating end of the device of this invention. The sharp, cutting tip has been removed from the head for cleaning or repair, for example. The matching flutes can be seen in the shaft thereof.

FIG. 4 is a showing of the details of the penetrating cutting element 5 of the head element. In this showing, two faces 15 and **15*a* of the penetrating cutting element 5 are shown. It is preferred that there be four faces but in this showing, only two can be seen. Flutes 13 and 13*a* permit the extinguishing agent to flow down through the holes 16 and 16*a* formed by the flutes matching with grooves in the body 4** (still not shown) when the device is mated to the head. These holes will form a downward angle of spray discharge of from about 45° to 80° compared to a line drawn down the longitudinal length of the cutting element.

Figure 5:
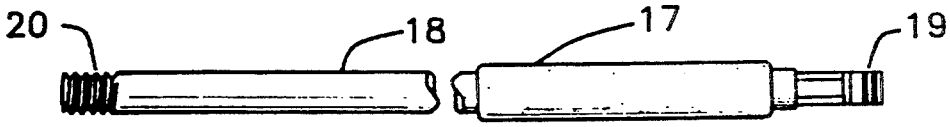
FIG. 5 is a detailed showing of an alternative linear handle element of this invention. In this showing, the linear handle may be connectable both to the penetrating element and a portable fire extinguisher and in the cut-away portion of this figure a sleeved element is placed over the hollow portion of the linear handle. In this showing, the linear handle is connectable to the penetrating head by threads.

FIG. 5 is another showing of an alternative embodiment of the linear handle. In this showing 17 is a handle cover which is placed over a hollow tube 18, shown in cut-away. At one end of this particular handle is a quick connecting means 19. The other end 20 is threaded. In this particular embodiment, this particular handle will be threaded into the penetrating head element (not shown in this figure). This permits other materials to be used in the construction of the handle and also permits the removal of the handle from the head in order to clean up the device.

Figure 6:
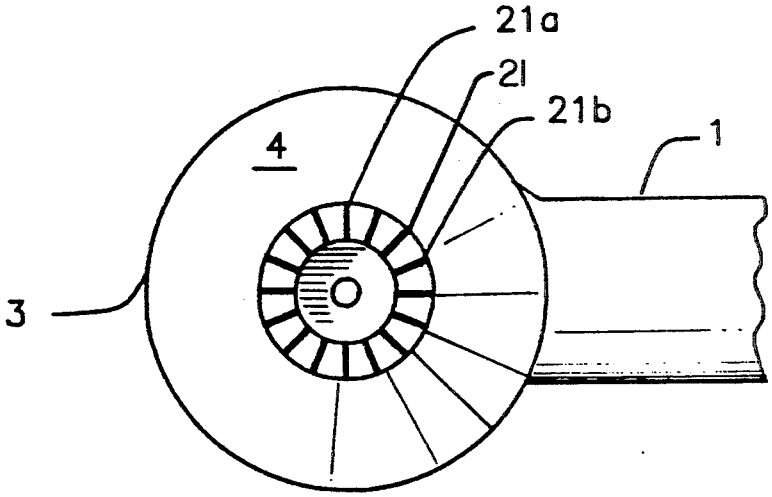
FIG. 6 is a downward showing of the body of the penetrating head element of this invention after the sharp, cutting element has been removed. In this showing, the hollow interior and grooves contained therein can also be seen.

FIG. 6 is a showing of the body element 4 looking down through the hole left by removing the cutting element therefrom. In this view, several grooves 21, 21a, 21 bet seq. are seen placed within the flared end of the hollow body of the head element 3 which will mate with flutes in the cutting element 5 when the two are connected.

Figure 7:
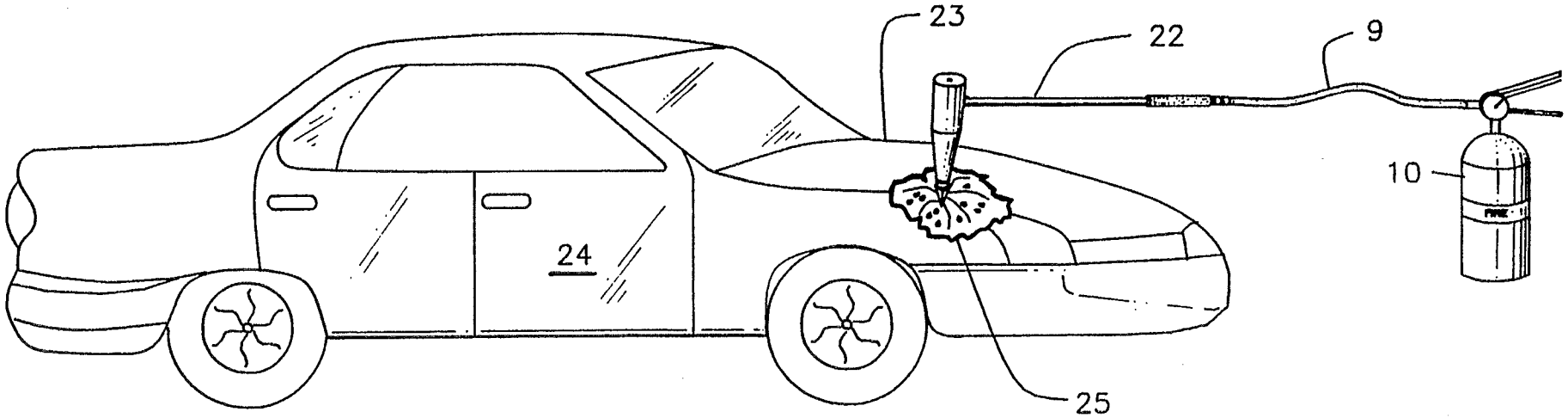
FIG. 7 is a showing of the device of this invention being used on a fire contained within the engine compartment of an automobile.

FIG. 7 is a showing of the portable fire fighting tool of this invention 22 being used to penetrate the hood 23 of a vehicle 24, in this case an automobile. The tool is connected by a hose 9 to a portable fire extinguisher 10. An umbrella like spray of fire extinguishing agent 25 can be seen exiting beneath the penetrated hood.

DETAILS

The portable fire fighting tool of this invention can be used with a host of sources of fire extinguishing agents including liquids (e.g. water and foam); dry chemicals; and gasses (e.g. ($CO_2$ and Halon®). This device is unique in its portability and thus is most useful with portable fire extinguishers and the like. When fighting fires contained within the engine compartment of an automobile or truck, for example, any of the many conventional portable fire extinguishers may be used in connection therewith. Since the entire apparatus, including the fire extinguisher itself, is highly portable, the equipment can be carried within the trunk of an automobile or in a small truck. Thus, the first responder to any fire may have this unit within his possession and be able to effectively combat an engine fire in an vehicle without waiting for any particular assistance and the device of this invention is designed to be used by a single person or fire fighter. Alternatively, fire fighting stations within garages and the like can keep this device handy with other fire fighting equipment in case one of the automobiles parked therein over-heats, and a fire results. This device can also be a common piece of equipment used by fire fighters and can be easily carried within the trucks and vehicles used by these individuals. When a fire inside the engine compartment of an automobile or truck is spotted, and there is no ready access to release the hood and open the engine compartment, a single person involved in fighting this fire can easily connect the device to the appropriate fire extinguisher, take the device easily to the fire, and, grabbing the end of the linear handle which is attached to the penetrating head element, force the cutting element down onto and through the top of the hood. This motion is similar to having an individual swinging an ax or splitting maul. The device will easily penetrate the sheet metal of the hood causing the cutting element and a portion of the penetrating head element to enter into the engine compartment. Discharging the fire extinguisher will cause the fire fighting agent to travel from the fire extinguisher through a hose connected between the linear handle element of the device and down through the penetrating head into the engine compartment. The portable tool of this invention, through the flutes, grooves and holes formed thereby, will spray streams of fire fighting agent out in a umbrella-like shape over the engine controlling or completely extinguishing the fire. The damage to the automobile or truck will be minimized, since the fire can be extinguished early and since the small hole placed in the hood by the device of this invention will be slight and can be repaired by using conventional body shop techniques. The danger to the fire fighter is also minimized. There is no necessity to pry open the hood of the vehicle and waste valuable fire fighting time to apply an extinguishing agent on the fire while minimizing the potential for the fire to flare up. Additionally, the longer an engine fire continues, the more chance that the vehicle will become consumed by the fire or even explode. Thus, time is of the essence and the device of this invention will save that time and prevent a larger fire from occurring.

In yet another embodiment of this invention, in the same manner of fighting an engine fire, the portable fire fighting tool of this invention can be used to put out a fire in a trunk of a vehicle, for example.

In the manufacture of the portable fire fighting tool of this invention, many of the conventional, easily obtained materials may be used. For example, the penetrating hollow element, which comprises a head and a sharp, removable cutting element on one end thereof, may be made from any conventional, non-corrosive materials. We prefer steels and in particular stainless steel since that material adds resistance to corrosion and considerable weight to the penetrating element itself. The cutting element is designed to cut through sheet metal and any associated reinforcing means such as that contained in an automobile or truck hood or trunk lid. The cutting element will cut sharply and cleanly through this metal leaving an easily repaired hole. The cutting element itself may be made from tool quality steel (prefer stainless steel) and heat treated to insure a hardness of Rockwell 50–55 to allow durability. Since the cutting element can easily be removed from the penetrating element itself, it is easily replaced if it becomes damaged during use or removed for cleaning after fighting a fire.

The cutting element is comprised of the cutting tip which may be made with several faces. The cutting tip is held in place by any conventional holding means (e.g. by a threaded bolt which is placed through the hollow head itself and connected thereto). We prefer four faces which will leave a neat, square hole in the sheet metal after penetrating therein. This shaft also may be comprised from a steel or stainless steel element. Several flutes pass down the shaft. There are grooves cut within the flared hollow portion of the body. When the cutting element is placed within the hollow body element, these grooves match with the flutes permit any extinguishing agent to pass downwardly through the grooves. The grooves and flutes will form holes at the exit point just above the cutting element. These holes will form a spray angle of from about 45° to about 80° to a line described by the hollow section of the head element. There can be a plurality of grooves placed in this manner. We prefer from four to twenty-four grooves with eight to sixteen being especially preferred. Thus, the fire extinguishing agent will flow out as streams along this route, forming an umbrella-like spray of fire extinguishing agent to put out the fire. This head element is designed to be welded to the handle element with the head being perpendicular to the shaft of the handle. This mode is preferred. Alternatively, the handle element may be separate from the head or cutting element and attached thereto with threads provided therein and thereon so as to fit snugly within the hollowed portion of the penetrating head element. In both modes, easy passage of the fire extinguishing agents from the fire extinguisher, through the linear handle element and the hollow penetrating body element is permitted and this material will exit in an umbrella-like formation out over the top of cutting tip of the cutting element as shown in FIG. 7.

In the aforementioned alternative embodiment, on the penetrating body element, preferably near the top solid end, a threaded receptacle would be placed therein. This receptacle will receive a threaded pipe element which will make up the hollow, linear handle element placed therein. Preferably, however, the penetrating element is welded or glued to the linear handle element.

Although an angle of 90° between the linear handle and that of the penetrating head element is preferred, any angle of from 45° to 120° may also be used as well.

The hollow, linear handle element may also be made from many conventional materials. We prefer making this part of the device from a stainless steel material, although a simple steel pipe or heat resistive plastic may also be used. This element may, as mentioned previously, have one end threaded so as to fit within a matching threaded receptacle located in the penetrating head element. On the other end of this tubular handle, any quick connecting device that can be connected to a conventional fire extinguisher exit hose may be present. Thus, when one uses the portable, fire fighting tool of this invention, one simply connects the linear handle element having a matching quick connect, dis-connect device on the end of the hose of a standard fire extinguisher which also has a matching quick connect, disconnect device therein. To help in the use, the linear handle may be covered with a gripping material to facilitate the gripping and provide a cushioning means thereto. Since the device of this invention is small and easily portable, it can be easily carried in the trunk of a vehicle along with the associated fire extinguishing agent (e.g. the fire extinguisher).

To use the device, the user grasps the linear handle and by using an overhead swing, forces the cutting element down through the sheet metal covering the fire. This can be done by one user and no additional devices are necessary to get the device of this invention to penetrate the hood or trunk of a vehicle. Discharging the fire extinguisher will result in a quantity of fire extinguishing agent (e.g. foam, water, dry chemical, Halon ® and $CO_2$) to flow through the hollow linear handle element and down through the hollow body of the head element and out over the penetrating element of this head. This fire extinguishing agent will then flow through the penetrating head element and exit through the holes formed by the grooves in the penetrating head when mated with the flutes in the cutting element to control or extinguish the fire. No assembly tools are required thus saving time in fighting the fire. Additionally, the device of this invention utilizes fire extinguishing agents more efficiently. For example, in a 10 pound fire extinguisher using $CO_2$, the device of this invention can extend the normal discharge time of the extinguisher as compared to the extinguisher alone. Thus, the contents of the extinguisher can be used more efficiently and for a longer period The device of this invention can be carried by fire fighters in the fire fighting vehicles or in the trunk of a fire fighter's vehicle. Alternatively, police and other emergency personnel may be able to carry this device within their vehicles. The device of this invention may also be present at toll plazas, rest areas along turnpikes and other road-ways; parking garages; ferry boats and other areas where a large number of vehicles are kept.

We claim:

1. A portable fire fighting tool comprising a hollow linear handle element having a quick connecting means on one end thereof and a penetrating head element on the other end, wherein said penetrating head element comprises a body with a hollow interior tapering down to a flared end having a sharp, removable cutting element on one end, said cutting element comprising a shaft insertable and connectable within said tapered and flared end and a cutting tip having a top and a sharp point extending out from said shaft, wherein when a line is drawn through the longitudinal axis of said penetrating element, said line forms an angle of 45° to 120° to said handle element, said shaft of said cutting element having a series of flutes therein and said hollow tapered and flared end of said body having a series of grooves therein, said flutes in said shaft of said cutting element forming a series of holes emanating from the top of said cutting tip when said cutting element is mated to said flared and tapered end of said hollow body of said head by inserting said shaft therein, said holes providing openings to the hollow interior of said body of said penetrating element, the hollow portion of said penetrating element being connected to said hollow handle element permitting a flow through said handle to the interior of said penetrating element.

2. The portable fire fighting tool of claim 1 wherein a fire extinguisher containing a fire extinguishing agent is connected to the connecting means on said handle element.

3. The portable fire fighting tool of claim 2 wherein said angle formed by said handle and said head is 90°.

4. The portable fire fighting tool of claim 2 wherein after fire extinguishing agent is caused to flow through said hollow handle and said head, said agent will disperse fire extinguishing agent through said holes at an angle of 45° to 80° to a perpendicular line described along said hollow portion of said penetrating head element.

5. The portable fire fighting tool of claim 2 wherein said fire extinguishing agent is selected from the group consisting of foam, water, dry chemical, Halon ®and $CO_2$.

6. The portable fire fighting tool of claim 1 wherein said cutting tip element is removable from said penetrating head.

7. The cutting element of claim 6 wherein said cutting tip is fashioned from four faces.

8. The portable fire fighting tool of claim 1 wherein said hollow, linear handle is connected to said penetrating head element by welding.

9. The portable fire fighting tool of claim 1 wherein said penetrating head element is made from stainless steel and said linear handle element is made from fire resistant plastic.

10. The portable fire fighting tool of claim 1 wherein said means for attaching said removable, sharp, cutting element to said head element is a threaded bolt.

11. The portable fire fighting tool of claim 1 wherein all elements are made from stainless steel and said tool is used for fighting fires contained within a vehicle.

* * * * *